US010837686B2

(12) United States Patent
Lee et al.

(10) Patent No.: US 10,837,686 B2
(45) Date of Patent: Nov. 17, 2020

(54) CONTROL METHOD FOR REFRIGERATOR

(71) Applicant: LG Electronics Inc., Seoul (KR)

(72) Inventors: Namgyo Lee, Seoul (KR); Sunghee Kang, Seoul (KR); Jindong Kim, Seoul (KR); Hyuksoon Kim, Seoul (KR); Yoonseong Nam, Seoul (KR); Jihyun Im, Seoul (KR); Yonghyeon Cho, Seoul (KR); Taehwa Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 44 days.

(21) Appl. No.: 16/087,956

(22) PCT Filed: Mar. 24, 2017

(86) PCT No.: PCT/KR2017/003231
§ 371 (c)(1),
(2) Date: Sep. 24, 2018

(87) PCT Pub. No.: WO2017/164710
PCT Pub. Date: Sep. 28, 2017

(65) Prior Publication Data

US 2019/0120533 A1 Apr. 25, 2019

(30) Foreign Application Priority Data

Mar. 24, 2016 (KR) ..... 10-2016-0035198
Nov. 30, 2016 (KR) ..... 10-2016-0161305

(51) Int. Cl.
*F25B 49/02* (2006.01)
*F25D 29/00* (2006.01)
(Continued)

(52) U.S. Cl.
CPC ..... *F25B 49/022* (2013.01); *F25B 7/00* (2013.01); *F25D 17/065* (2013.01); *F25D 29/00* (2013.01);
(Continued)

(58) Field of Classification Search
CPC ..... F25D 2600/02; F25D 17/065; F25D 2700/12; F25B 2600/23; F25B 2600/01;
(Continued)

(56) References Cited

U.S. PATENT DOCUMENTS

2003/0097850 A1* 5/2003 Chang ..... F25D 17/065 62/156
2004/0188935 A1* 9/2004 Nam ..... F25D 17/045 273/255
2011/0041539 A1* 2/2011 Nylykke ..... F25D 17/042 62/276

FOREIGN PATENT DOCUMENTS

KR 100149916 5/1999
KR 1020050056722 6/2005
(Continued)

OTHER PUBLICATIONS

KR-20110071167-A English Translation (Year: 2011).*
International Search Report in International Application No. PCT/KR2017/003231, dated Jul. 17 2017, 4 pages.

*Primary Examiner* — Marc E Norman
*Assistant Examiner* — Schyler S Sanks
(74) *Attorney, Agent, or Firm* — Fish & Richardson P.C.

(57) ABSTRACT

A control method for a refrigerator comprises: decreasing an output of at least one of a cold air supply means for a first storage chamber or stopping the cold air supply means, if a sensed temperature of the first storage chamber reaches a value less than or equal to a second reference temperature; increasing the output, if a certain time has passed after the temperature has reached the value less than or equal to the
(Continued)

second reference temperature, or if the temperature reaches a first specific value between a first reference temperature and the second reference temperature; and decreasing the output or stopping the cold air supply means, if a certain time has passed after the output of the air supply means has been changed in a previous step, or if the temperature reaches a preset second specific value between the first specific value and the second reference temperature.

10 Claims, 7 Drawing Sheets

(51) Int. Cl.
*F25D 17/06* (2006.01)
*F25B 7/00* (2006.01)

(52) U.S. Cl.
CPC ... *F25B 2400/06* (2013.01); *F25B 2700/2104* (2013.01); *F25D 2700/12* (2013.01)

(58) Field of Classification Search
CPC ..... F25B 49/022; F25B 7/00; F25B 2400/06; F25B 2700/2104; F25B 2700/2117
See application file for complete search history.

(56) References Cited

FOREIGN PATENT DOCUMENTS

| | | | |
|---|---|---|---|
| KR | 100498395 | | 7/2005 |
| KR | 1020050103097 | | 4/2006 |
| KR | 20110071167 A | * | 6/2011 |
| KR | 1020160011110 | | 5/2016 |

* cited by examiner

CONTROL METHOD FOR REFRIGERATOR

CROSS-REFERENCE TO RELATED APPLICATIONS

This application is a National Stage application under 35 U.S.C. § 371 of International Application No. PCT/KR2017/003231, filed on Mar. 24, 2017, which claims the benefit of Korean Application No. 10-2016-0161305, filed on Nov. 30, 2016, and Korean Application No. 10-2016-0035198, filed on Mar. 24, 2016. The disclosures of the prior applications are incorporated by reference in their entirety.

TECHNICAL FIELD

The present invention relates to a control method for a refrigerator.

BACKGROUND ART

Refrigerators are home appliances that store foods at a low temperature. It is essential that a storage chamber is always maintained at a constant low temperature. At present, in the case of household refrigerators, the storage chamber is maintained at a temperature within the upper and lower limit ranges on the basis of a set temperature. That is, the refrigerator is controlled through a method in which when the storage chamber increases to the upper limit temperature, a refrigeration cycle operates to cool the storage chamber, and when the storage chamber reaches the lower limit temperature, the refrigeration cycle is stopped.

Recently, a refrigerator has been developed in which an evaporator and an expansion device are respectively installed in a freezing compartment and a refrigerating compartment. The refrigerator controls each expansion device to adjust an amount of refrigerant supplied from the compressor to each evaporator, thereby respectively maintaining internal temperatures of the freezing compartment and the refrigerating compartment at a refrigeration temperature and a freezing temperature.

A refrigerator and a control method thereof are disclosed in Korean Patent Publication No. 10-2016-0011110 (published on Jan. 29, 2016) that is a prior art document.

The refrigerator according to the prior art document includes a first refrigeration device for cooling the freezing compartment and a second refrigeration device for cooling the refrigerating compartment.

The first refrigeration device and the second refrigeration device operate at the same time to lower the temperature of each of the freezing compartment and the refrigerating compartment. Also, if the temperature of the refrigerating compartment is less than a desired temperature, the operation of the first refrigeration device is stopped.

Here, if the temperature of the refrigerating compartment does not satisfy the desired temperature, the first and second refrigeration devices are controlled to continuously operate.

Also, if the temperature of the freezing compartment is less than a desired temperature, the operation of the second refrigeration device is stopped. Here, if the temperature of the freezing compartment does not satisfy the desired temperature, the first and second refrigeration devices are controlled to continuously operate.

However, according to the prior art document, since the first and second refrigeration devices operate at the same time until the temperature of the refrigerating or freezing compartment satisfies the desired temperature, power consumption increases.

Also, according to the prior art document, since turn on/off of each of the refrigeration devices is determined based on the desired temperature of each of the refrigerating compartment and the freezing compartment, the refrigeration device may be frequently turned on/off to increase in power consumption.

If the first refrigeration device and the second refrigeration device alternately operate in the prior art document, the power consumption may decrease. However, it is difficult to maintain each of the freezing compartment and the refrigerating compartment at a predetermined temperature, i.e., a constant temperature.

DISCLOSURE OF THE INVENTION

Technical Problem

An object of the present invention is to provide a refrigerator in which a storage chamber is maintained at a constant temperature and a control method thereof.

Also, an object of the present invention is to provide a refrigerator in which a cooling cycle for maintaining a storage chamber at a constant temperature operates to reduce power consumption and a control method thereof.

An object of the present invention is to provide a refrigerator that is controlled to reduce possibility in which a temperature of a storage chamber deviates form a normal temperature so as to improve freshness of a stored object and a control method thereof.

An object of the present invention is to provide a refrigerator that is capable of solving defrosting reliability while a storage chamber is maintained at a constant temperature and a control method thereof.

An object of the present invention is to provide a refrigerator that is capable of reducing power consumption of a cold air supply means while a storage chamber is maintained at a constant temperature and a control method thereof.

Technical Solution

A method for controlling a refrigerator including a first compressor and a second compressor, which compress a refrigerant, a first evaporator receiving the refrigerant from the first compressor to generate cold air for cooling a first storage chamber, a first cooling fan for supplying the cold air into the first storage chamber, a second evaporator receiving the cold air from the second compressor to generate cold air for cooling the second storage chamber, and a second cooling fan for supplying the cold air into the second storage chamber, wherein a cooling cycle of the first storage chamber and a cooling cycle of the second storage chamber operate at the same time or alternately operate, includes: sensing a temperature of the first storage chamber; increasing an output of a cold air supply means for the first storage chamber when the sensed temperature of the first storage chamber reaches a value that is equal to or above a first reference temperature for the first storage chamber; a decreasing at least one output of the cold air supply means for the first storage chamber or stopping the cold air supply means when the sensed temperature of the first storage chamber reaches a value that is equal to or below a second reference temperature for the first storage chamber; increasing at least one output of the cold air supply means for the first storage chamber when a predetermined time elaspes, or the sensed temperature of the first storage chamber reaches a first specific value (N+a) between the first reference temperature and the second reference temperature for the first storage chamber after the temperature of the first storage chamber reaches the value that is below the second reference temperature; and decreasing at least one output of the cold air supply means for the first storage chamber or stopping the cold air supply means when a predetermined time elapses, or the sensed temperature of the first storage chamber reaches a previously set second specific value (N+b) between the first specific value (N+a) and the second reference temperature after the output of the cold air supply means is changed in the previous step.

The method of the present invention may further include: increasing an output of a cold air supply means for the second storage chamber after the sensed temperature of the first storage chamber reaches a value that is equal to or below the second reference temperature for the first storage chamber; and decreasing the output of the cold air supply means for the second storage chamber or stopping the cold air supply means for the second storage chamber after the sensed temperature of the second storage chamber reaches the first reference temperature for the second storage chamber.

In order to prevent a period in which the supply of the cold air for the first storage chamber and the supply of the cold air for the second storage chamber are performed at the same time from increasing, when the sensed temperature of the first storage chamber reaches the value that is equal to or above the first reference temperature for the first storage chamber while the output of the cold air supply means for the second storage chamber occurs, the method may further include decreasing or stopping the output of the cold air supply means for the second storage chamber when a predetermined time elapses from the time point at which the sensed temperature of the first storage chamber reaches the value that is above the first reference temperature, or the sensed temperature of the first storage chamber reaches a previously set third specific value (N+c) between the first reference temperature and the second reference temperature for the first storage chamber.

The first specific value (N+a) may be greater than the second reference temperature for the first storage chamber and less than a target temperature for the first storage chamber.

The third specific value (N+c) may be greater than the target temperature of the first storage chamber and less than the first reference temperature for the first storage chamber.

The cold air supply means for the first storage chamber may include the first cooling fan, and the cold air supply means for the second storage chamber may include the second cooling fan.

The cold air supply means for the first storage chamber may include the first cooling fan and the first compressor, and when the sensed temperature of the first storage chamber reaches the value that is below the second reference temperature for the first storage chamber, the step of decreasing or stopping the at least one output of the cold air supply means for the first storage chamber may include a step of turning off the first cooling fan in a state in which the first compressor is turned on.

In the step of increasing the at least one output of the cold air supply means for the first storage chamber when the temperature of the first storage chamber reaches the first specific value (N+a) between the first reference temperature and the second reference temperature, the first compressor that is in operating state may be turned off, and the first cooling fan may be turned on.

The steps for controlling the output of the cold air supply means for the first storage chamber according to the temperature of the first storage chamber after decreasing or stopping the at least one output of the cold air supply means for the first storage chamber when the sensed temperature of the first storage chamber reaches the value that is below the second reference temperature for the first storage chamber may be ended when a set time elapses from a time point at which the temperature of the first storage chamber reaches the value that is below the second reference temperature for the first storage chamber, or a temperature value measured by a sensor for sensing a temperature of the first evaporator reaches a set value.

A condenser for the first storage chamber and a condenser for the second storage chamber may constitute one heat exchanger and be divided into two parts through which the refrigerant flows, the refrigerant for cooling the first storage chamber may flow through a first part of the condenser, and the refrigerant for cooling the second storage chamber may flow through a second part of the condenser, and a condenser fin for the first part and a condenser fin for the second part may be connected to each other.

A method for controlling a refrigerator according to another aspect includes: stopping a refrigerating cycle for cooling a refrigerating compartment and operating a freezing cycle for cooling a freezing compartment; operating the refrigerating cycle when a temperature of the refrigerating compartment reaches a first refrigerating compartment reference temperature during the operation of the freezing cycle; determining whether a stop condition of the freezing cycle is satisfied during the operation of the freezing cycle; stopping the freezing cycle when the stop condition of the freezing cycle is satisfied; and stopping the refrigerating cycle and operating the freezing cycle when the sensed temperature of the refrigerating compartment reaches a second refrigerating compartment reference temperature less than the first refrigerating compartment reference temperature.

In the step of determining whether the stop condition of the freezing cycle is satisfied, whether the temperature of the freezing compartment reaches a first freezing compartment reference temperature less than a target temperature of the freezing compartment may be determined.

In the step of determining whether the stop condition of the freezing cycle is satisfied, when it is determined that the sensed temperature of the refrigerating compartment reaches a stop reference temperature before the temperature of the freezing compartment reaches the first freezing compartment reference temperature, the freezing cycle may be stopped.

The stop reference temperature may be a temperature between the first refrigerating compartment reference temperature and the target temperature of the refrigerating compartment.

In the step of determining whether the stop condition of the freezing cycle is satisfied, whether a reference time elapses after the operation of the refrigerating cycle starts may be determined, and when the reference time elapses after the operation of the refrigerating cycle starts, the freezing cycle may be stopped.

In the step of stopping the refrigerating cycle and operating the freezing cycle, when the temperature of the refrigerating compartment reaches a fan turn-on reference temperature, a refrigerating compartment fan may be turned on.

When the temperature of the refrigerating compartment reaches a fan turn-off reference temperature after the refrigerating compartment fan is turned on, the refrigerating compartment fan may be turned off.

The fan turn-on reference temperature may be a temperature greater than the fan turn-off reference temperature, and the fan turn-off reference temperature may be a temperature greater than the second refrigerating compartment reference temperature.

The fan turn-on reference temperature may be a temperature greater than that of each of a target temperature of the refrigerating compartment and the second refrigerating compartment reference temperature.

In the step of stopping the refrigerating cycle and operating the freezing cycle, when the refrigerating cycle is stopped, and the first reference time elapses, the refrigerating compartment fan may be turned on.

When the refrigerating compartment fan is turned on, and a second reference time elapses, the refrigerating compartment fan may be turned off.

A refrigerator according to further another aspect includes: a freezing cycle including a compressor for a freezing compartment and operating for cooling the freezing compartment; a refrigerating cycle including a compressor for a refrigerating compartment and a refrigerating compartment fan and operating for cooling the refrigerating compartment; a freezing compartment temperature sensor sensing a temperature of the freezing compartment; a refrigerating compartment temperature sensor sensing a temperature of the refrigerating compartment; and a control unit controlling operations of the freezing cycle and the refrigerating cycle on the basis of the temperature sensed by each of the temperature sensors.

The control unit may operate the refrigerating cycle when the temperature of the refrigerating compartment reaches a first refrigerating compartment reference temperature greater than a target temperature of the refrigerating compartment and may stop the refrigerating cycle and operate the freezing cycle when the temperature of the refrigerating compartment reaches a second refrigerating compartment reference temperature less than the target temperature of the refrigerating compartment.

Also, the control unit may stop the freezing cycle when a temperature of the freezing compartment reaches a first freezing compartment reference temperature less than a target temperature of the freezing compartment.

When the sensed temperature of the refrigerating compartment reaches a stop reference temperature before the freezing compartment temperature reaches the first freezing compartment reference temperature, the control unit may stop the freezing cycle.

When a refrigerating compartment fan turn-on condition is satisfied after the refrigerating cycle is stopped, the refrigerating compartment fan may be stopped after being turned on.

Advantageous Effects

According to the proposed invention, the temperature of the refrigerating compartment may be maintained within the set temperature range of the refrigerating compartment, and also, the temperature of the freezing compartment may be maintained within the set temperature range of the freezing compartment.

Thus, the storage period of the foods stored in the refrigerator may increase. That is, the phenomenon in which the foods stored in the refrigerating compartment are overcooled or withered may be removed.

Also, since the time taken to allow the refrigerating cycle and the freezing cycle to operate at the same time while each of the refrigerating compartment and the freezing compartment is maintained at the constant temperature decreases, the power consumption may be reduced.

Also, since the turn-off period of the cooling cycle for cooling the refrigerating compartment or the freezing compartment increases, the number of turn on/off operations of the cold air supply means may decrease to reduce the power consumption.

MODE FOR CARRYING OUT THE INVENTION

Figure 1:
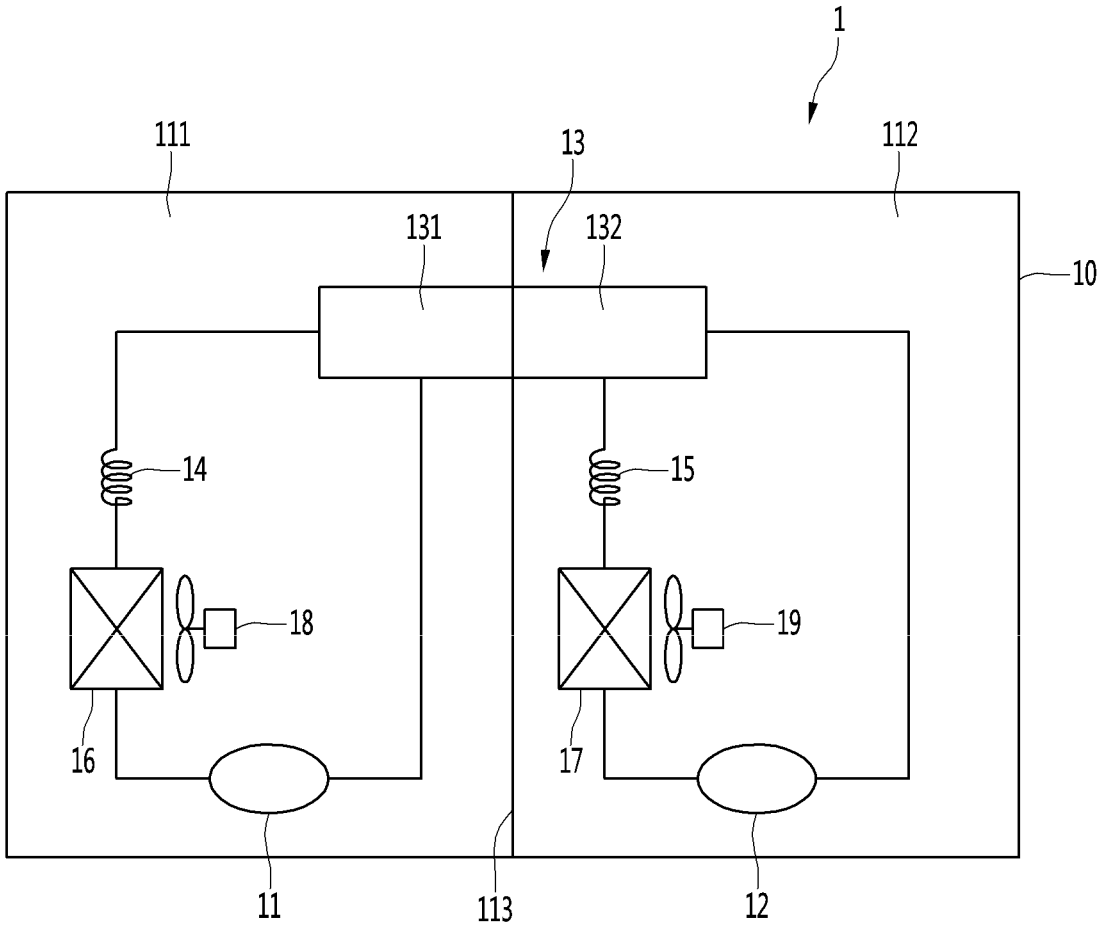
FIG. 1 is a schematic view illustrating a configuration of a refrigerator according to an embodiment of the present invention.

Hereinafter, embodiments of the present invention will be described in detail with reference to the accompanying drawings. It is noted that the same or similar components in the drawings are designated by the same reference numerals as far as possible even if they are shown in different drawings. In the following description of the present invention, a detailed description of known functions and configurations incorporated herein will be omitted to avoid making the subject matter of the present invention unclear.

In the description of the elements of the present invention, the terms first, second, A, B, (a), and (b) may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

Figure 2:
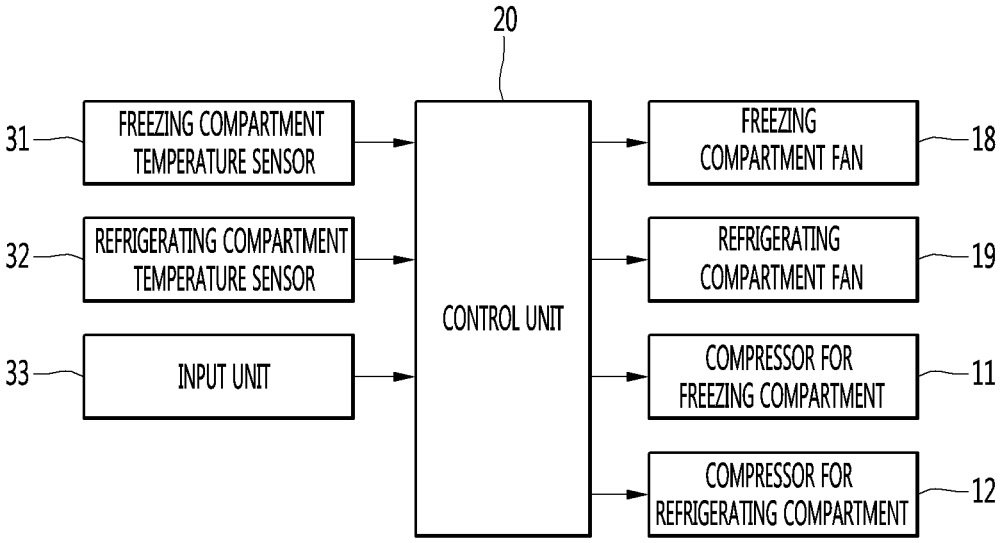
FIG. 2 is a block diagram of the refrigerator according to the present invention.

FIG. 1 is a schematic view illustrating a configuration of a refrigerator according to an embodiment of the present invention, and FIG. 2 is a block diagram of the refrigerator according to the present invention.

Referring to FIGS. 1 and 2, a refrigerator 1 according to the present invention may include a cabinet 10 having a freezing compartment 111 and a refrigerating compartment 112 therein and a door (not shown) coupled to the cabinet 10 to open and close each of the freezing compartment 111 and the refrigerating compartment 112.

An object to be stored such as a food may be stored in each of the freezing compartment 111 and the refrigerating compartment 112.

The freezing compartment 111 and the refrigerating compartment 112 may be horizontally or vertically partitioned within the cabinet 10 by a partition wall 113.

Also, the refrigerator 1 may include a cooling cycle for cooling each of the freezing compartment 111 and the refrigerating compartment 112.

The cooling cycle may include a freezing cycle for cooling the freezing compartment 111 and a refrigerating cycle for cooling the refrigerating compartment 112.

The freezing cycle may include a compressor 11 (or a first compressor) for the freezing compartment, a condenser 13, a first expansion member 14, a first evaporator 16, and a freezing compartment fan 18. The freezing compartment fan 18 may blow air toward the first evaporator 16 to circulate cold air of the freezing compartment 111.

In the present invention, the compressor 11 for the freezing compartment and the freezing compartment fan 18 may be called a "cold air supply means for the freezing compartment", which operates to supply cold air to the freezing compartment 111.

The refrigerating cycle may include a compressor 12 (or a second compressor) for the refrigerating compartment, a condenser 13, a second expansion member 15, a second evaporator 17, and a refrigerating compartment fan 19. The refrigerating compartment fan 19 may blow air toward the second evaporator 17 to circulate cold air of the refrigerating compartment 112.

In the present invention, the compressor 12 for the refrigerating compartment and the refrigerating compartment fan 19 may be called a "cold air supply means for the refrigerating compartment", which operates to supply cold air to the refrigerating compartment 112.

Here, the condenser 13 may constitute one heat exchanger and also be divided into two parts through which a refrigerant flows. That is, the refrigerant discharged from the first compressor 11 may flow through a first part 131 of the condenser 13, and the refrigerant discharged from the second compressor 12 may flow through a second part 132 of the condenser 13.

To improve condensation efficiency of the condenser 13, a condenser fin for the first part 131 and a condenser fin for the second part 132 may be connected to each other.

According to the present invention, when compared with a case in which two condensers are separately installed in a machine room, the condensation efficiency may be improved while reducing a space for installing the condenser. Thus, the first part 131 may be called a first condenser, and the second part 132 may be called a second condenser.

Also, the refrigerator 1 may further include a freezing compartment temperature sensor 31 (or a first temperature sensor) for sensing a temperature of the freezing compartment 111, a refrigerating compartment temperature sensor 32 (or a second temperature sensor) for sensing a temperature of the refrigerating compartment 112, an input unit 33 for inputting a target temperature (or a desired temperature) of each of the freezing compartment 111 and the refrigerating compartment 112, and a control unit 20 controlling the cooling cycle on the basis of the inputted target temperature and the temperatures sensed by the temperature sensors 31 and 33.

In this specification, a temperature greater than that target temperature of the freezing compartment 111 may be called a second freezing compartment reference temperature, and a temperature less than the target temperature of the freezing compartment 111 may be called a first freezing compartment reference temperature. Also, a range between the first freezing compartment reference temperature and the second freezing compartment reference temperature may be called a freezing compartment set temperature range.

Although not limited, the target temperature of the freezing compartment 111 may be a mean temperature of the first freezing compartment reference temperature and the second freezing compartment reference temperature.

In the present invention, the control unit 20 controls the temperature of the freezing compartment 111 to be maintained within the set temperature range. Here, the control for maintaining the temperature of the freezing compartment 111 within the set temperature range is called a "constant control of the freezing compartment".

Also, in this specification, a temperature greater than that target temperature of the refrigerating compartment 112 may be called a first refrigerating compartment reference temperature, and a temperature less than the target temperature of the refrigerating compartment 112 may be called a second refrigerating compartment reference temperature. Also, a range between the first refrigerating compartment reference temperature and the second refrigerating compartment reference temperature may be called a freezing compartment set temperature range.

Although not limited, the target temperature of the refrigerating compartment 112 may be a mean temperature of the first refrigerating compartment reference temperature and the second refrigerating compartment reference temperature.

In the present invention, the control unit 20 controls the temperature of the refrigerating compartment 112 to be maintained within the set temperature range. Here, the control for maintaining the temperature of the refrigerating compartment 112 within the set temperature range is called a "constant control of the refrigerating compartment".

Figure 3:
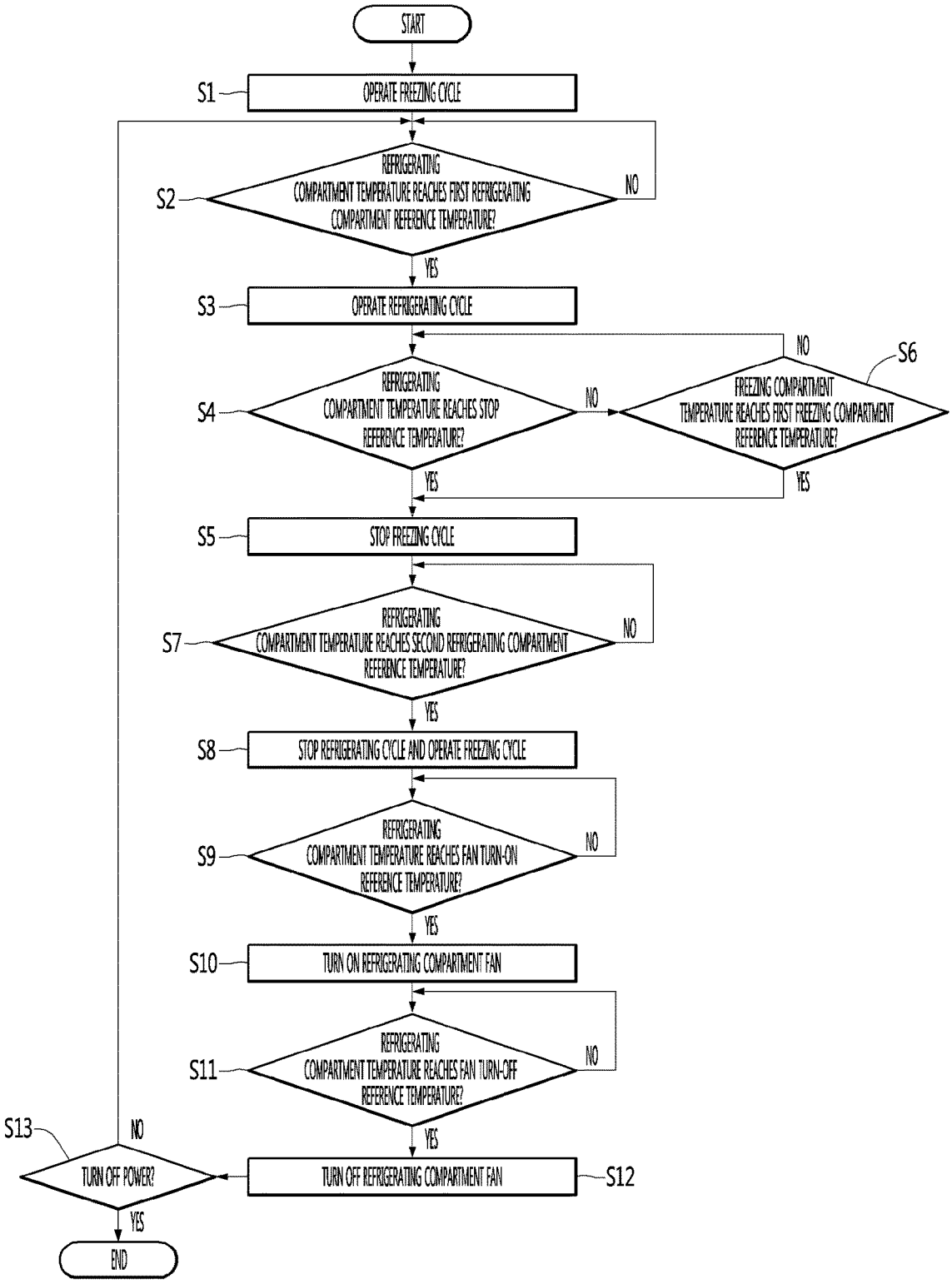
FIG. 3 is a flowchart illustrating a method for controlling the refrigerator according to an embodiment of the present invention.
Figure 4:
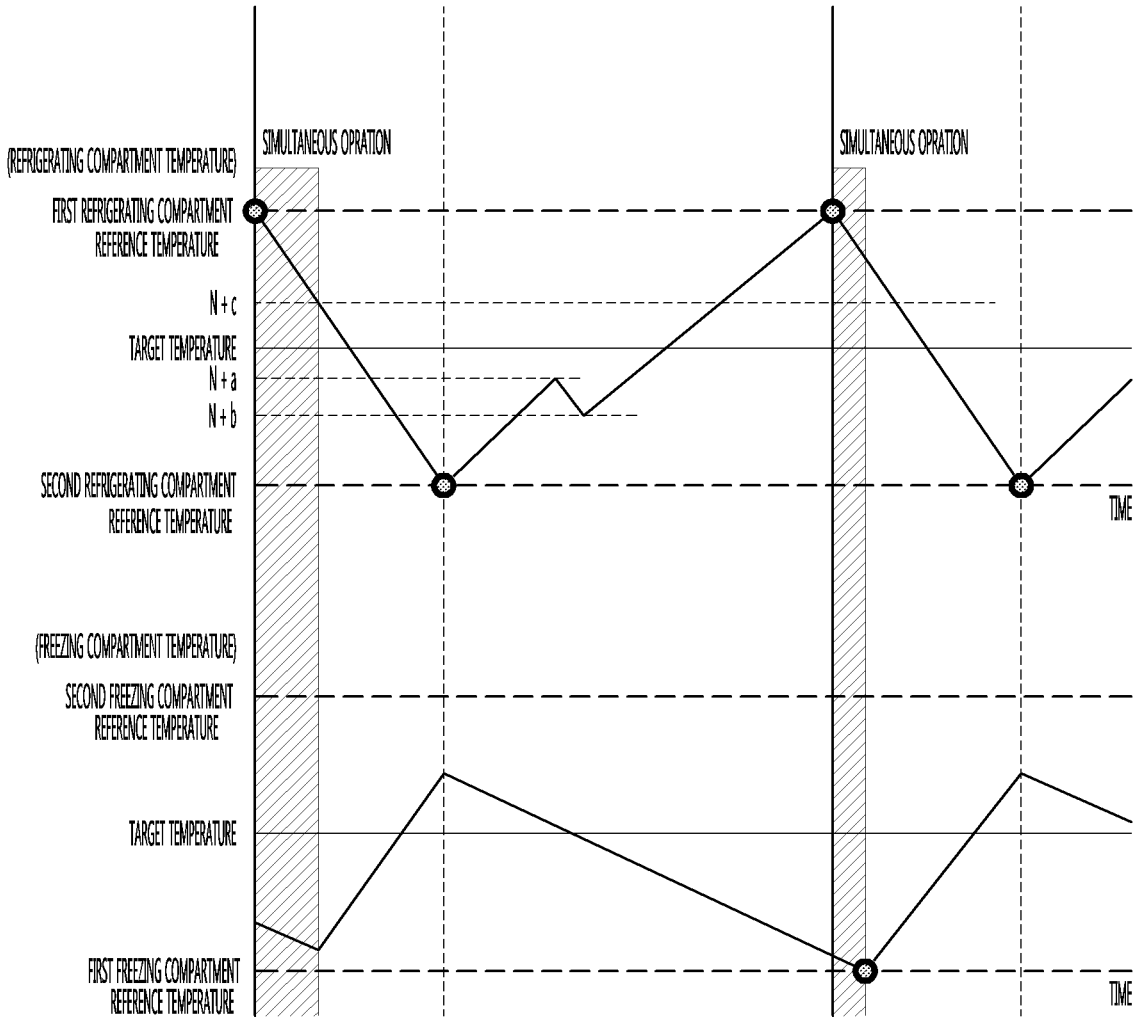
FIG. 4 is a view illustrating a variation in temperature of a freezing compartment and a refrigerating compartment and an operation state of a cooling cycle according to the method for controlling the refrigerator according to an embodiment of the present invention.

FIG. 3 is a flowchart illustrating a method for controlling the refrigerator according to an embodiment of the present invention, and FIG. 4 is a view illustrating a variation in temperature of the freezing compartment and the refrigerating compartment and an operation state of the cooling cycle according to the method for controlling the refrigerator according to an embodiment of the present invention.

Hereinafter, a method for controlling each of the freezing cycle and the refrigerating cycle at a constant temperature according to a variation in temperature of the freezing compartment and the refrigerating compartment while the freezing cycle operates in a state in which the refrigerating cycle is stopped will be described.

In the following, an operation logic for reducing the power consumption and improving the cooling cycle by reducing a period for which a cycle for cooling a first storage chamber (one of the freezing compartment and the refrigerating compartment) and a cycle for cooling a second storage chamber (the other one of the freezing compartment and the refrigerating compartment) operate at the same time will be described.

The operation logic may be applied to the cooling cycle having the period for which the cold air supply means for the first storage chamber and the second storage chamber operate at the same time.

The cooling cycle for the first storage chamber and the second storage chamber may respectively constitute cooling cycles so that the cold air supply means independently operate according to the first and second reference temperatures of the first storage chamber and the first and second reference temperatures of the second storage chamber.

In the cooling cycle for the first storage chamber, when the temperature of the first storage chamber reaches the first reference temperature of the first storage chamber, an output of the cold air supply means for the first storage chamber may increase. Also, when the temperature of the first storage chamber reaches the second reference temperature for the first storage chamber, the output of the cold air supply means for the first storage chamber may operate to decrease.

Separately, in the cooling cycle for the second storage chamber, when the temperature of the second storage chamber reaches the second reference temperature of the second storage chamber, an output of the cold air supply means for the second storage chamber may increase. Also, when the temperature of the second storage chamber reaches the second reference temperature for the second storage chamber, the output of the cold air supply means for the second storage chamber may operate to decrease.

In this case, the period for which the cold air supply means for the first storage chamber and the second storage chamber operate at the same time may occur to increase in power consumption. Particularly, when the condenser for the first storage chamber and the condenser for the second storage chamber are commonly used, cooling efficiency may be reduced in the simultaneous operating period to more increase in power consumption.

The case in which the condenser for the first storage chamber and the condenser for the second storage chamber are commonly used is as follows.

The condenser 13 may constitute one heat exchanger and also be divided into two parts through which the refrigerant flows. That is, the refrigerant discharged from the first compressor 11 may flow through a first part 131 of the condenser 13, and the refrigerant discharged from the second compressor 12 may flow through a second part 132 of the condenser 13. Thus, the first part 131 may be called a first condenser, and the second part 132 may be called a second condenser.

The cooling cycle for the first storage chamber and the second storage chamber may respectively constitute cooling cycles so that the cooling cycles operate according to the first reference temperature of the first storage chamber and the second reference temperature of the second storage chamber.

In the cooling cycle for the first storage chamber, when the temperature of the first storage chamber reaches the first reference temperature of the first storage chamber, an output of the cold air supply means for the first storage chamber may increase. When the temperature of the first storage chamber reaches the second reference temperature for the first storage chamber, the output of the cold air supply means for the first storage chamber may decrease or be stopped.

In the cooling cycle for the second storage chamber, when the temperature of the first storage chamber reaches the second reference temperature of the first storage chamber, an output of the cold air supply means for the second storage chamber may increase. When a predetermined time elapses after the temperature of the first storage chamber reaches the first reference temperature for the first storage chamber, or the temperature of the first storage chamber reaches a specific temperature (N+c) after reaching the first reference temperature for the first storage chamber, the output of the cold air supply means for the second storage chamber may decrease or be stopped.

Since the above-described cycle is performed, the simultaneous operating period may be reduced to reduce the power consumption and improve the cooling efficiency of the cycle.

Explaining one example with reference to FIGS. 1 to 4, in the state in which the refrigerating cycle is stopped, the freezing cycle may operate to control the constant temperature of the freezing compartment 111 (S1). That is, to control the constant temperature of the freezing compartment 111, the compressor 11 for the freezing compartment and the freezing compartment fan 18 operate.

When the freezing cycle operates, the freezing compartment 111 decreases in temperature. On the other hand, in the state in which the refrigerating cycle is stopped, the refrigerating compartment 112 increases in temperature.

The temperature of the refrigerating compartment 112 is periodically sensed by the refrigerating compartment temperature sensor 32, and the temperature of the freezing compartment 111 is periodically sensed by the freezing compartment temperature sensor 31.

The control unit 20 determines whether the sensed temperature of the refrigerating compartment reaches the first refrigerating compartment reference temperature (S2).

As the determination result in the operation S2, when it is determined that the sensed temperature of the refrigerating compartment reaches the first refrigerating compartment reference temperature, the control unit 20 operates the refrigerating cycle (S3). That it, to decrease the temperature of the refrigerating compartment 112, the control unit 20 operates the compressor 12 for the refrigerating compartment and the refrigerating compartment fan 19.

Here, the freezing cycle may already be in operation at the time point at which the refrigerating cycle operates.

After the operation of the refrigerating cycle starts, the control unit 20 may determine whether the sensed temperature of the refrigerating compartment 111 reaches a stop reference temperature (N+c) (a third specific value) (S4).

In the present invention, the stop reference temperature is a temperature for determining whether a stop condition of the freezing cycle is satisfied.

As the determination result in the operation S4, when it is determined that the sensed temperature of the refrigerating compartment 112 reaches the stop reference temperature, the control unit 20 operates the freezing cycle (S5). That is, the control unit 20 stops the operations of the compressor 11 for the freezing compartment and the freezing compartment fan 18.

On the other hand, as the determination result in the operation S4, when it is determined that the sensed temperature of the refrigerating compartment 112 does not reach the stop reference temperature, the control unit 20 determines whether the temperature of the freezing compartment 111, which is sensed by the freezing compartment temperature sensor 31, reaches the first freezing compartment reference temperature (S6).

As the determination result in the operation S6, when it is determined that the sensed temperature of the freezing compartment reaches the first freezing compartment reference temperature, the control unit 20 stops the freezing cycle (S5).

In the present invention, the operations S4 and S6 may be called a step for determining whether the stop condition of the freezing cycle is satisfied.

In the present invention, the freezing cycle and the refrigerating cycle may operate at the same time. Here, the more the time for which the freezing cycle and the refrigerating cycle operate at the same time increases, the more the power consumption increases.

Thus, in the present invention, as the time for which the refrigerating cycle and the freezing cycle operate at the same time decreases, if it is determined that the sensed temperature of the refrigerating compartment 112 reaches the stop reference temperature even before the temperature of the freezing compartment 111 reaches the first freezing compartment reference temperature after the refrigerating cycle operates, the freezing cycle is stopped.

Here, the stop reference temperature is a temperature between the first refrigerating compartment reference temperature and the second refrigerating compartment reference temperature.

When the stop reference temperature is close to the second refrigerating compartment reference temperature, the simultaneous operation time of the refrigerating cycle and the freezing cycle may increase, and when the stop reference temperature is close to the first refrigerating compartment reference temperature, the simultaneous operation time of the refrigerating cycle and the freezing cycle may decrease.

Thus, although not limited, the stop reference temperature may be set to a temperature between the target temperature of the refrigerating compartment 112 and the first refrigerating compartment reference temperature.

For another example, as the determination result in the operation S4, when it is determined that the sensed temperature of the refrigerating compartment does not reach the stop reference temperature, the control unit may determine whether the reference time elapses after the refrigerating cycle operation time. Also, when the reference time elapses after the refrigerating cycle operation time, the freezing cycle may be stopped.

In the present invention, the step of determining whether the time elapses after the refrigerating cycle operation time may be called a step of determining whether the stop condition of the freezing cycle is satisfied.

During the operation of the refrigerating cycle, when the sensed temperature of the refrigerating compartment reaches the second refrigerating compartment reference temperature, the control unit 20 stops the refrigerating cycle and operates the freezing cycle (S8).

That is, in the present invention, an operation start time point of the refrigerating cycle is a time point at which the temperature of the refrigerating compartment 111 reaches the first refrigerating compartment reference temperature, and a stop time point of the refrigerating cycle is a time point at which the temperature of the refrigerating compartment 111 reaches the second refrigerating compartment reference temperature. Also, an operation start time point of the freezing cycle is a time point at which the temperature of the refrigerating compartment 111 reaches the second refrigerating compartment reference temperature.

As a result, a start time point of the freezing cycle may be determined according to a vibration in temperature of the refrigerating compartment 112.

Since one condenser is used to be divided into two parts, when the operation of the refrigerating cycle starts, and thus, the refrigerating cycle and the freezing cycle operate at the same time, a condensation temperature of the condenser 13 may increase, and thus, the power consumption increases, and the operation time of the freezing cycle increases.

When the operation start time point of the freezing cycle is determined according to the variation in temperature of the refrigerating compartment 112, if it is assumed that the operation S6 is not applied, following problems may occur.

When the operation time of the freezing cycle increases, the next freezing cycle ((N+1)-th) after the present freezing cycle (N-th) decreases in operation time. In this case, since a standby time until the freezing cycle operates again after the next freezing cycle operates increases, the next freezing cycle ((N+2)-th) after one may increase in operation time.

This causes a problem that the power consumption of the compressor for the freezing compartment due to the increase in operation time of the freezing cycle.

However, when the freezing cycle and the refrigerating cycle operate according to the present invention, when it is determined that the sensed temperature of the refrigerating compartment reaches the stop reference temperature even before the sensed temperature of the freezing compartment reaches the first freezing compartment reference temperature after the refrigerating cycle operates, the freezing cycle may be stopped to prevent the freezing cycle and the refrigerating cycle from overlapping operate.

Hereinafter, an operation logic including a temperature rising delay output period will be described (operations S9 and S10).

The operation logic may be applied to all the cycles irrespective of whether the period in which the cold air supply means for the first storage chamber and the second storage chamber operate at the same time.

To improve the freshness of the object stored in the refrigerator, it is necessary to reduce a degree of variation in temperature within the storage chamber according to the time.

That is, when a temperature deviation between the first reference temperature (e.g., an upper limit value) and the second reference temperature (e.g., a lower limit value), by which at least one output adjustment operation (including turn on/off) of the cold air supply means (the compressor, a blowing fan, a damper disposed on a passage connecting the freezing compartment to the refrigerating compartment, a refrigerant switching valve for switching a flow direction of the refrigerant, and the like), is reduced, the freshness of the stored object may be improved.

Figure 5:
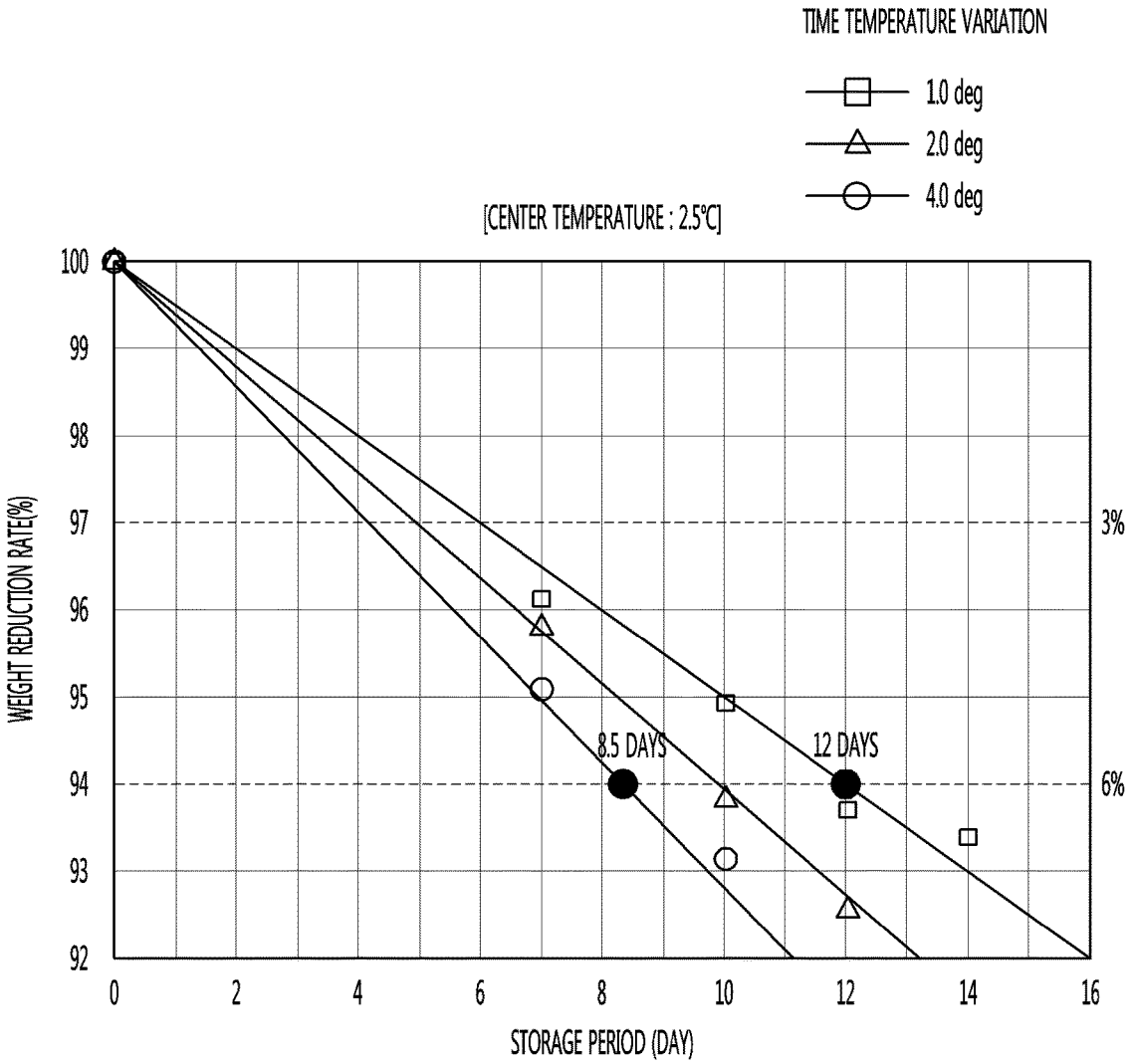
FIG. 5 is a graph illustrating a storage period according to a temperature deviation between a first reference temperature and a second reference temperature.

FIG. 5 is a graph illustrating a storage period according to a temperature deviation between the first reference temperature and the second reference temperature.

For example, referring to FIG. 5, a temperature deviation between the first reference temperature and the second reference temperature is reduced from 4 degrees to 1 degree, it is seen that the storage period of the stored object increases. That is, for example, it is seen that the day when a weight of vegetables is reduced by 6% increases from 8.5 days to 12 days.

When the temperature deviation between the first reference temperature and the second reference temperature is reduced to improve the freshness, the number of times of the adjustment (including the number of times of the turn on/off) of the output of the cold air supply means increases to cause problems in part reliability of the cold air supply means, and the power consumption due to the frequent on/off operation may increase. As described above, to improve the part reliability and reduce the power consumption due to the frequent on/off operation, a temperature rising delay means may operate at a time point at which the temperature of the storage chamber reaches the second reference temperature.

The refrigerator has the first storage chamber and the second storage chamber, and also, the refrigerator has the first reference temperature (e.g., the upper limit value) and the second reference temperature (e.g., the lower limit value) for the storage chambers. Also, the temperature of each of the storage chambers may be controlled to be maintained between the first reference temperature and the second reference temperature.

For example, the control unit of the refrigerator may reduce or stop an output of the fan for blowing and maintain the operation of the compressor when the sensed temperature of the storage chamber reaches the second reference temperature during the operation of the cooling cycle.

When a predetermined time elapses, or the temperature of the storage chamber reaches a predetermined temperature (e.g., N+a) (a first specific value), the output of the compressor may be reduced or stopped, and the fan for blowing the cold air may be turned on to delay the temperature rising of the storage chamber.

For another example, the control unit of the refrigerator may reduce or stop the output of the fan for blowing and also reduce or stop the output of the compressor when the sensed temperature of the storage chamber reaches the second reference temperature during the operation of the cycle.

When a predetermined time elapses, or the temperature of the storage chamber reaches a predetermined temperature (e.g., N+a), the output of the compressor may be reduced or stopped, and the fan for blowing the cold air may be turned on to delay the temperature rising of the storage chamber.

Explaining one example with reference to FIGS. 1 to 4, during the operation of the freezing cycle, the control unit 20 may determine whether the sensed temperature of the refrigerating compartment reaches a fan turn-on reference temperature (N+a) (S9).

As the determination result in the operation S9, when it is determined that the sensed temperature of the refrigerating compartment reaches the fan turn-on reference temperature, the control unit 20 turns on the refrigerating compartment fan 19 (S10). That is, in the state in which the refrigerating cycle is stopped, the refrigerating compartment fan 19 is turned on to allow the cold air to flow toward the evaporator 17 for the refrigerating compartment.

When the sensed temperature of the refrigerating compartment reaches the fan turn-on reference temperature, it is determined that a turn-on condition of the refrigerating compartment fan 19 is satisfied.

In the present invention, the reason in which the refrigerating compartment fan 19 is turned on is for decreasing the temperature of the refrigerating compartment 112 by using latent heat of the evaporator 17 for the refrigerating compartment so that a turn-off period of the refrigerating cycle increases.

In general, since the compressor 12 for the refrigerating compartment requires a large amount of cooling power at the beginning of the operation, the power consumption of the compressor 12 for the refrigerating compartment increases. When the turn-off period of the compressor 12 for the refrigerating compartment increases, the number of times of the turn-on operation of the compressor 12 for the refrigerating compartment may decrease to reduce the power consumption.

Thus, according to the present invention, in the state in which the compressor 12 for the refrigerating compartment and the refrigerating compartment fan 19 are stopped, when the sensed temperature of the refrigerating compartment reaches the fan turn-on reference temperature, the refrigerating compartment fan 19 may be turned on to increase the turn-off period of the refrigerating cycle, thereby reducing the power consumption.

In the present invention, the fan turn-on reference temperature may be a temperature between the target temperature of the refrigerating compartment 112 and the first refrigerating compartment reference temperature. Also, the fan turn-on reference temperature may be less than the stop reference temperature.

Hereinafter, a protection logic (operations S11 and S12), which operates to stop the temperature rising delay output will be described.

The protection logic may be applied to all the cycles irrespective of whether the period in which the cold air supply means for the first storage chamber and the second storage chamber operate at the same time.

As described above, when a period of the operation due to the temperature rising delay output is added, the temperature of the storage chamber may gradually vary between the first reference temperature and the second reference temperature. However, since a period for which the cold air is supplied in the entire cooling cycle increases, possibility of forming frost on the evaporator may increase.

As described above, to solve the problem in defrosting reliability, which occurs due to the excessive formation of the frost on the evaporator, the protection logic for stopping the temperature rising delay output may be added.

For example, after the cold air supply means operates by the temperature rising delay output, when a predetermined time elapses, or the temperature of the storage chamber reaches a predetermined temperature (e.g., N+b) (a second specific value), the output of the cold air supply means may be reduced or stopped.

Alternatively, when the temperature sensed by the sensor for measuring the temperature of the evaporator for the refrigerating compartment reaches a set value, the operation logic including the temperature rising delay output period may be ended. That is, the control of the output of the cold air supply means for the first storage chamber may be ended.

Explaining one example with reference to FIGS. 1 to 4, after the refrigerating compartment fan 19 is turned on, the control unit 20 determines whether the sensed temperature of the refrigerating compartment reaches a fan turn-off reference temperature (N+b) (S11).

As the determination result in the operation S11, when it is determined that the sensed temperature of the refrigerating compartment 112 reaches the fan turn-off reference temperature, the control unit 20 turns off the refrigerating compartment fan 19 (S12).

In the present invention, the fan turn-off reference temperature may be a temperature less than the fan turn-on reference temperature and between the fan turn-on reference temperature and the second refrigerating compartment reference temperature.

In the present invention, when the refrigerating compartment temperature reaches the fan turn-off reference temperature during the operation of the refrigerating compartment fan 19, the reason, in which the refrigerating compartment fan 19 is turned off, is for preventing the evaporator 17 for the refrigerating compartment from being frozen.

For another example, when the refrigerating compartment fan 19 is stopped, and the first reference time elapses, the refrigerating compartment fan 19 may be turned on. When the refrigerating compartment fan 19 is turned on, and the second reference time elapses, the refrigerating compartment fan 19 may be turned off.

Here, the first reference time may be determined to a time that is enough to allow the temperature of the refrigerating compartment 112 to reach a temperature that is close to the target temperature of the refrigerating compartment 112 while the refrigerating cycle is stopped, and thus, the refrigerating compartment 112 increases in temperature.

Also, the second reference time may be determined to a time that is enough to allow the temperature of the refrigerating compartment 112 to reach a temperature greater by a predetermined temperature than the second refrigerating compartment reference temperature while the refrigerating compartment fan 19 is turned on, and thus, the refrigerating compartment 112 decreases in temperature.

The case in which the refrigerating cycle is stopped, and the first reference time elapses, it is determined that the turn-on condition of the refrigerating compartment fan 10 is satisfied.

When power of the refrigerator is not turned off after the refrigerating compartment fan 19 is turned off, the process returns to the operation S2.

That is, when the refrigerating compartment temperature reaches the first refrigerating compartment reference temperature during the operation of the freezing cycle, the refrigerating cycle operates.

Here, although not shown in FIG. 3, a step of determining whether the freezing compartment temperature reaches the first freezing compartment reference temperature during the operation of the freezing cycle may be added. That is, the same operation as the operation S6 may be added between the operations S1 and S2.

In this case, when the temperature of the freezing compartment reaches the first freezing compartment reference temperature even before the temperature of the refrigerating compartment reaches the first refrigerating compartment reference temperature during the operation of the freezing cycle, the freezing cycle may be stopped. In this state, all the freezing cycle and the refrigerating cycle may be in the stopped state.

According to the present invention, the temperature of the refrigerating compartment may be maintained within a set temperature range of the refrigerating compartment, and also, the temperature of the freezing compartment may be maintained within a set temperature range of the freezing compartment.

Thus, the storage period of the foods stored in the refrigerator may increase. That is, a phenomenon in which the foods stored in the refrigerating compartment are overcooled or withered may be removed.

Also, since the time taken to allow the refrigerating cycle and the freezing cycle to operate at the same time while each of the refrigerating compartment and the freezing compartment is maintained at the constant temperature decreases, the power consumption may be reduced.

Also, since the turn-off period of the refrigerating cycle increases, the number of times of the turn-on operation of the compressor for the refrigerating compartment may decrease to reduce the power consumption.

Figure 6:
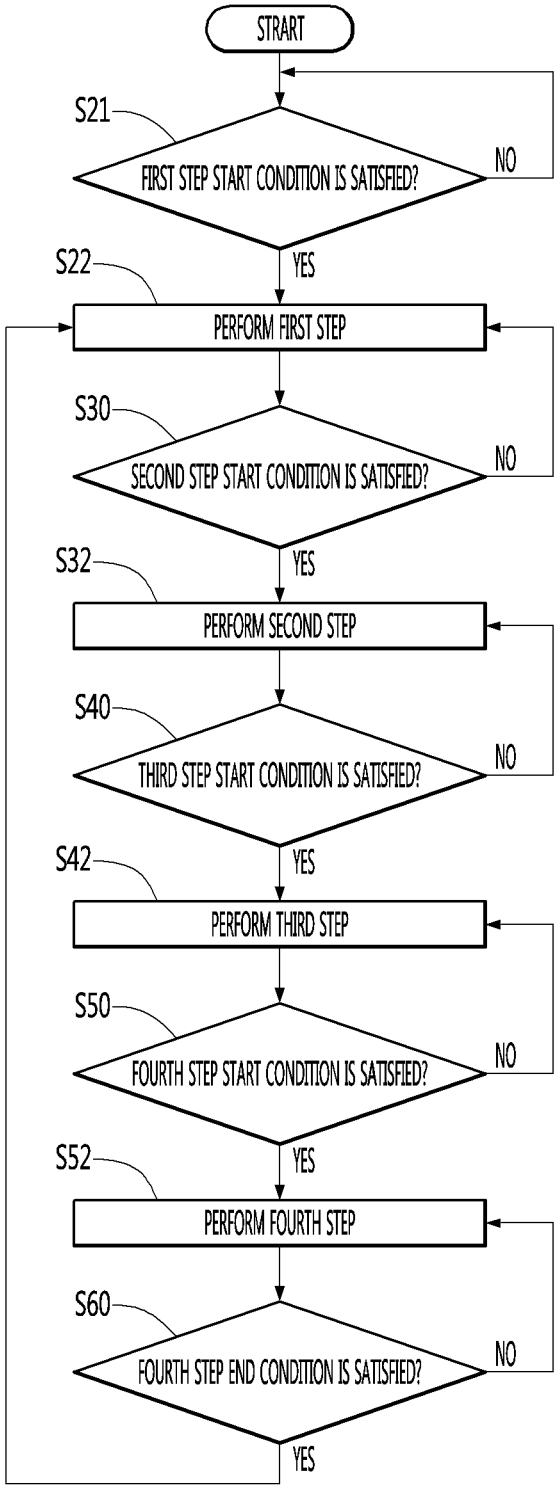
FIG. 6 is a flowchart illustrating a method for controlling a refrigerator according to another embodiment of the present invention.
Figure 7:
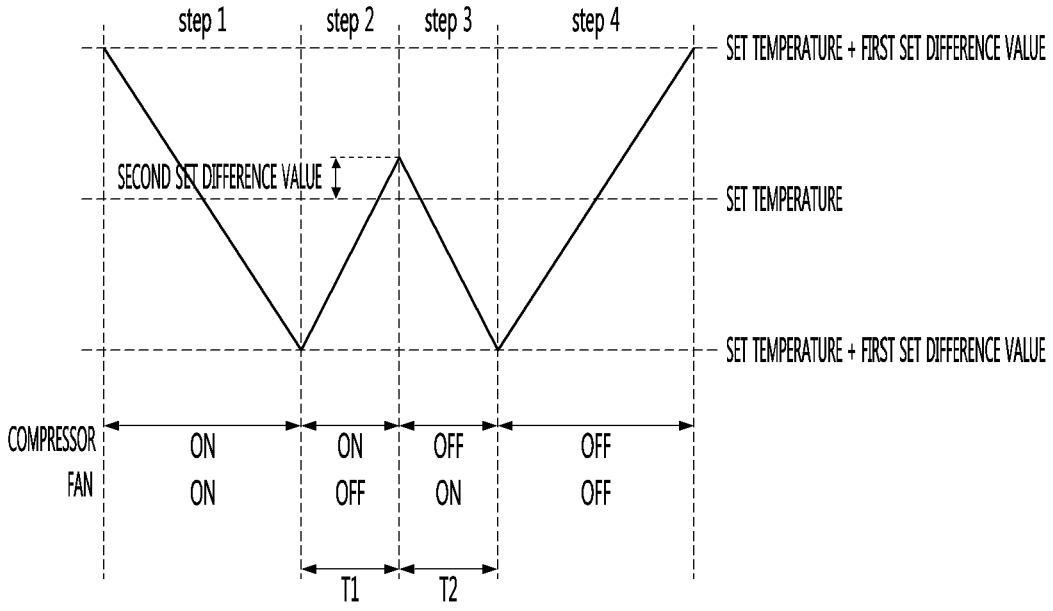
FIG. 7 is a view illustrating a variation in temperature of a storage chamber according to the method for controlling the refrigerator according to another embodiment of the present invention.

FIG. 6 is a flowchart illustrating a method for controlling a refrigerator according to another embodiment of the present invention, and FIG. 7 is a view illustrating a variation in temperature of a storage chamber according to the method for controlling the refrigerator according to another embodiment of the present invention.

This embodiment is the same as the forgoing embodiment except for an operation logic including a temperature rising delay output period and a protection logic. Thus, only characterized parts in this embodiment will be described below.

Referring to FIGS. 6 and 7, total four steps may be successively performed to maintain a temperature of the storage chamber, which is selected as one of a refrigerating compartment and a freezing compartment, at a constant temperature in this embodiment.

The refrigerator may form one cooling cycle by using a single compressor and a single evaporator.

Alternatively, for example, two compressors and two evaporators may be used to form two cooling cycles.

In this specification, in case in which the storage chamber is the refrigerating compartment, the compressor and a fan may be a compressor for the refrigerating compartment and a fan for the refrigerating compartment. Also, in case in which the storage chamber is the freezing compartment, the compressor and a fan may be a compressor for the freezing compartment and a fan for the freezing compartment.

A control method of the refrigerator according to the present invention may include a first step for driving the compressor compressing a refrigerant and the fan moving air, a second step of driving the compressor and stopping the fan, a third step of stopping the compressor and driving the fan, and a fourth step of stopping the compressor and the fan.

When the fourth step is ended, the first step may be performed just.

In the first step, the storage chamber decreases in temperature, and in the second step, the storage chamber increases in temperature. In the third step, the storage chamber decreases in temperature, and in the fourth step, the storage chamber increases in temperature. Thus, in the control method, the above-described temperature distribution may be realized.

The first step starts when a start condition of the first step is satisfied (S21). The start condition of the first step may represent a temperature (a first reference temperature) obtained by adding a temperature variation range that is allowed at a set temperature of the storage chamber, i.e., a first set difference value. That is, when the temperature of the storage chamber increases by a difference value between a set temperature and a first set temperature, the first step is performed (S22).

Here, the first set temperature difference value may be approximately 0.5.

In the first step, since the compressor is driven, the evaporator may be cooled, and the temperature of the storage chamber may decrease while the air cooled through the evaporator moves to the storage chamber by the fan. Here, the temperature of the storage chamber may be changed in a curved shape rather than a straight line as illustrated in FIG. 7, but it is expressed by a straight line in FIG. 7 for convenience of explanation.

While the first step is performed, it is determined where a start condition of the second step is satisfied (S30). Here, the start condition of the second step is the same as an end condition of the first step. This is done because when the first step is ended, the second step is performed immediately.

The first step may be ended at a temperature (a second reference temperature) of the temperature of the storage chamber, which is obtained by subtracting the first set difference value from the set temperature. That is, the second step may start at a temperature of the storage chamber, which is obtained by subtracting the first set difference value from the set temperature.

Thus, in the first step, the storage chamber may be changed within a range of a temperature obtained by adding the first set difference value to the set temperature and a temperature obtained by subtracting the first set difference value from the set temperature. Here, if the first set difference value is approximately 0.5, in the first step, the temperature may be changed within a range of 1 degree based on the set temperature of the storage chamber.

In the second step, the compressor is maintained to be driven, but the driving of the fan is stopped (S32). Since the compressor is driven, air around the evaporator is cooled at a low temperature in the evaporator. However, since the fan is not driven, most of the air cooled by the evaporator may not move to the storage chamber and be located around the evaporator.

Thus, the temperature of the storage chamber increases relative to the temperature at the beginning of the second step.

While the second step is performed, it is determined where a start condition of the third step is satisfied (S40). Here, the start condition of the third step is the same as an end condition of the first step. This is done because when the second step is ended, the third step is performed immediately.

That is, the second step may be ended when the temperature of the storage chamber reaches a temperature obtained by adding the second set difference value to the set temperature. Here, the second set difference value may increase as an external temperature of the refrigerator increases. The increase in the second set difference value may represent that the performed time of the second step increases.

TABLE 1

| External temperature (° C.) | T < 18 | 18 < T < 22 | 22 < T < 34 | 34 < T |
|---|---|---|---|---|
| Second set difference value | Decreases <-> Increase | | | |

When an external temperature T increases, a more amount of cold air for cooling the storage chamber is required. That is, when the external temperature is high, the compressor has to be further driven to cool the storage chamber at the same temperature.

In the second step, even through the compressor is not driven in the third step, it is necessary to secure sufficient cold air for cooling the storage chamber. Therefore, to accumulate more cold air in the second step, as the external temperature increases, the performed time of the second step has to be longer. For this, the second set difference value may be changed largely from the set temperature and the second set difference value, which are the end conditions of the second step, to end the second step after waiting until the temperature of the storage chamber further increase.

Also, the user tends to be relatively sensitive to noise when the compressor repeats the driving and stopping with frequent cycles. Also, since energy efficiency is deteriorated by repeatedly driving and stopping the compressor, it is preferable that the compressor is stopped after driving enough to avoid driving for a long time after ensuring sufficient cold air after starting the compressor.

As shown in Table 1, the second set difference value may be changed in size with the total four sections. For example, the second set difference value may be selected according to a temperature measured by an external temperature sensor while having only four variation values.

The second set difference value may be less than the first set difference value. That is, the temperature of the storage chamber at the end time point of the second step is preferably less than that of the storage chamber at the start time point of the first step.

It is preferable that the temperature variation range in the first step includes the temperature variation range in the second step so that the temperature variation range of the storage chamber decreases. Thus, the storage chamber may be changed within a narrow range around the set temperature, and the temperature variation range of the storage chamber may be reduced.

It may be determined whether the second step is performed for the first set time T1 as another end condition of the second step (S40).

TABLE 2

| External temperature (° C.) | T < 18 | 18 < T < 22 | 22 < T < 34 | 34 < T |
|---|---|---|---|---|
| First set time (T1) | Decreases <-> Increase | | | |

When the external temperature T increases, a more amount of cold air for cooling the storage chamber is required. That is, when the external temperature is high, the compressor has to be further driven to cool the storage chamber at the same temperature.

In the second step, even through the compressor is not driven in the third step, it is necessary to secure sufficient cold air for cooling the storage chamber. Therefore, to accumulate more cold air in the second step, as the external temperature increases, the performed time of the second step, i.e., a first set time T1 has to be longer.

As shown in Table 2, the first set time may be changed in size with the total four sections. For example, the first set time may be selected according to a temperature measured by the external temperature sensor while having only four change values.

The first set time T1 may be measured by a timer. The timer starts to measure an elapsed time when the second step starts, i.e., the compressor is driven, and the stop of the fan starts, and transmit information about whether the first set time T1 elapses to a control unit.

In the second step, the driving of the compressor is stopped, and the fan is driven (S42). Since the compressor is not driven, the cold air is not generated in the evaporator so that it is difficult to continuously cool air around the evaporator. In the second step, since the air around the evaporator is in the cooled state, when the fan is driven, the cooled air may move to the storage chamber to cool the storage chamber. Thus, as illustrated in FIG. 7, the internal temperature of the storage chamber may decrease.

In the third step, since the compressor is not driven, noise due to the compressor is not generated. Generally, since the noise generated by the compressor is less than that generated by the fan, the noise level in the third step may be less than that in the second step.

While the third step is performed, it is determined where a start condition of the fourth step is satisfied (S50). Here, the start condition of the fourth step is the same as an end condition of the third step. This is done because when the third step is ended, the fourth step is performed immediately.

The third step may be ended when the temperature of the evaporator reaches a specific temperature. The temperature of the evaporator may be measured by a temperature sensor for the evaporator. The specific temperature may represent a temperature at which the sublimation phenomenon of ice formed on the evaporator due to the operation of the fan is generated so that reliability of dew or icing in the storage chamber is not affected. The specific temperature may specifically be 0 degree or more, i.e., a temperature above zero.

Here, the temperature sensor for the evaporator may measure a temperature of the tube through which the refrigerant flows into the evaporator or a temperature of a side of the evaporator.

Also, the third step may be performed and ended during the second set time T2.

TABLE 3

| External temperature (° C.) | T < 18 | 18 < T < 22 | 22 < T < 34 | 34 < T |
|---|---|---|---|---|
| Second set time (T2) | Decreases <-> Increase | | | |

When the external temperature T increases, a more amount of cold air for cooling the storage chamber is required.

That is, when the external temperature is high, the compressor has to be further driven to cool the storage chamber at the same temperature. If it is determined that the external temperature is high in the second step, since the first set time is long, the compressor is driven for a longer time, and more cold air is accumulated. Thus, to sufficiently transfer the cold air accumulated in the second step to the storage chamber in the third step, it is possible to drive the fan for a longer time. That is, since more cold air is contained, the fan is further driven, and the cold air around the evaporator sufficiently moves to the storage chamber to cool the storage chamber.

As shown in Table 3, the second set time may be changed in size with the total four sections. For example, the second set time may be selected according to a temperature measured by the external temperature sensor while having only four change values.

It is also possible that the start condition of the fourth step starts when the temperature of the storage chamber reaches a value obtained by subtracting the first set difference value from the set temperature in addition to the above-mentioned two conditions. Since the related contents are the same as those in the case of starting the second step, detailed description will be omitted.

When the fourth step is performed, since the fan and the compressor are not driven, noise is not generated (S52). On the other hand, since the cold air is not supplied to the storage chamber, the temperature of the storage chamber may increase.

While the fourth step is performed, it is determined where an end condition of the fourth step is satisfied (S60). Here, the end condition of the fourth step is the same as a start condition of the first step. This is done because when the fourth step is ended, the first step is performed immediately.

That is, the fourth step may be ended at a temperature obtained by adding the first set difference value to the set temperature. Thus, the variation range of the internal temperature of the storage chamber may be included in the temperature variation range in the first step.

The temperature variation range in the first step may be the same as the temperature variation range in the fourth step.

In the present invention, since the compressor is driven only in the first stage and the second stage, and the compressor is not driven in the third stage and the fourth stage, the cycle for driving and stopping the compressor may be longer. Thus, the noise due to the driving of the compressor may be reduced.

In addition, since the driving period of the compressor increases, the energy efficiency consumed in operating the compressor may be improved. If the compressor is frequently turned on and off, the power consumed to drive the compressor may increase significantly.

Also, the temperature variation range of the first step includes a temperature variation range in the second step, the third step, and the third step so that the temperature of the storage chamber as a whole is changed within the temperature variation range in the first step. Alternatively, the temperature of the storage chamber may be changed within the temperature variation range in the fourth step. Therefore, the temperature range of the storage chamber may be reduced so that the temperature of the food stored in the storage chamber is maintained within a certain range, and the storage period of the food increases.

Particularly, the storage chamber may be a refrigerator compartment. Since the refrigerator has the temperature above zero as the set temperature, the food is stored at a temperature greater than that of the freezing compartment. Therefore, the food stored in the refrigerator is more sensitive to the temperature variation of the storage chamber than the food stored in the freezing compartment. The control flow described in the present invention may be applied to the refrigerating compartment to reduce the temperature variation range of the refrigerating compartment.

In this specification, although the two embodiments are described separately, but the present invention is not limited thereto, and the contents of the second embodiment may be added to the first embodiment, or two embodiments may be combined with each other.

It is to be understood that the invention is not limited to the disclosed embodiment, but, on the contrary, is intended to cover various modifications and equivalent arrangements included within the spirit and scope of the appended claims.

The invention claimed is:

1. A method for controlling a refrigerator, the refrigerator comprising a first compressor and a second compressor that are configured to compress a refrigerant, a first evaporator configured to receive the refrigerant from the first compressor to generate first cold air for cooling a first storage chamber, a first cooling fan configured to supply the first cold air into the first storage chamber, a second evaporator configured to receive the refrigerant from the second compressor to generate second cold air for cooling a second storage chamber, and a second cooling fan configured to supply the second cold air into the second storage chamber, wherein a cooling cycle of the first storage chamber and a cooling cycle of the second storage chamber operate at the same time or alternately operate, the method comprising:

sensing a temperature of the first storage chamber;

increasing a first output of a cold air supply means for the first storage chamber based on the sensed temperature of the first storage chamber being equal to or above a first reference temperature for the first storage chamber;

decreasing the first output of the cold air supply means for the first storage chamber or stopping the cold air supply means based on the sensed temperature of the first storage chamber being equal to or below a second reference temperature for the first storage chamber;

increasing the first output of the cold air supply means for the first storage chamber based on an elapse of a predetermined time or the sensed temperature of the first storage chamber corresponding to a first specific value between the first reference temperature and the second reference temperature for the first storage chamber after the temperature of the first storage chamber becomes equal to or below the second reference temperature;

decreasing the first output of the cold air supply means for the first storage chamber, or stopping the cold air supply means based on an elapse of a predetermined time after increasing the first output of the cold air supply means or based on the sensed temperature of the first storage chamber corresponding to a previously set second specific value between the first specific value and the second reference temperature;

increasing a second output of a cold air supply means for the second storage chamber based on the sensed temperature of the first storage chamber being equal to or below the second reference temperature for the first storage chamber; and decreasing the second output of the cold air supply means for the second storage chamber or stopping the cold air supply means for the second storage chamber based on an elapse of a predetermined time from a time point at which the sensed temperature of the first storage chamber becomes equal to or above the first reference temperature or based on the sensed temperature of the first storage chamber corresponding to a previously set third specific value between the first reference temperature and the second reference temperature for the first storage chamber, wherein decreasing the second output of the cold air supply means for the second storage chamber or stopping the cold air supply means for the second storage chamber is performed to avoid an increase of a period in which supply of the first cold air for the first storage chamber and supply of the second cold air for the second storage chamber are performed at the same time.

2. The method of claim 1, further comprising:

decreasing the second output of the cold air supply means for the second storage chamber or stopping the cold air supply means for the second storage chamber based on the sensed temperature of the second storage chamber corresponding to a first reference temperature for the second storage chamber.

3. The method of claim 2, wherein the third specific value is greater than the first specific value.

4. The method of claim 1, wherein the first specific value is greater than the second reference temperature for the first storage chamber and less than a target temperature for the first storage chamber.

5. The method of claim 1, wherein the third specific value is greater than a target temperature of the first storage chamber and less than the first reference temperature for the first storage chamber.

6. The method of claim 1, wherein the cold air supply means for the first storage chamber comprises the first cooling fan, and the cold air supply means for the second storage chamber comprises the second cooling fan.

7. The method of claim 1, wherein the cold air supply means for the first storage chamber comprises the first cooling fan and the first compressor, and wherein decreasing the first output of the cold air supply means for the first storage chamber comprises:

based on the sensed temperature of the first storage chamber being equal to or below the second reference temperature for the first storage chamber, turning off the first cooling fan in a state in which the first compressor is turned on.

8. The method of claim 7, wherein increasing the first output of the cold air supply means for the first storage chamber comprises turning off the first compressor and turning on the first cooling fan.

9. The method of claim 1, further comprising:

stopping controlling the first output of the cold air supply means for the first storage chamber according to the temperature of the first storage chamber after decreasing the first output of the cold air supply means for the first storage chamber or stopping the cold air supply means for the first storage chamber when the sensed temperature of the first storage chamber becomes equal to or below the second reference temperature for the first storage chamber based on an elapse of a set time from a time point at which the temperature of the first storage chamber becomes equal to or below the second reference temperature for the first storage chamber, or based on a temperature value measured by a sensor for sensing a temperature of the first evaporator corresponding to a set value.

10. The method of claim 1, wherein the refrigerator further comprises a condenser for the first storage chamber and a condenser for the second storage chamber that define one heat exchanger, the one heat exchanger having two parts comprising:

a first part that carries the refrigerant for cooling the first storage chamber, and a second part that carries the refrigerant for cooling the second storage chamber, and wherein the one heat exchanger comprises a first condenser fin that is disposed at the first part and a second condenser fin that is disposed at the second part and that is connected to the first condenser fin.

* * * * *